US007337926B2

(12) United States Patent
LeRoy

(10) Patent No.: US 7,337,926 B2
(45) Date of Patent: Mar. 4, 2008

(54) INTERMODAL POWDER/BULK FREIGHT CONTAINER

(76) Inventor: Curtis LeRoy, P.O. Box 3401, Oak Brook, IL (US) 60522-3401

( * ) Notice: Subject to any disclaimer, the term of this patent is extended or adjusted under 35 U.S.C. 154(b) by 524 days.

(21) Appl. No.: 10/999,237

(22) Filed: Nov. 30, 2004

(65) Prior Publication Data

US 2005/0121459 A1 Jun. 9, 2005

Related U.S. Application Data

(63) Continuation-in-part of application No. 10/274,185, filed on Oct. 18, 2002, now Pat. No. 7,104,425.

(51) Int. Cl.
*B67D 5/06* (2006.01)

(52) U.S. Cl. ..... 222/181.1; 222/185.1; 222/624; 222/625; 220/1.5; 220/562; 406/119; 414/498

(58) Field of Classification Search ..... 222/1, 222/185.1, 181.1, 624, 625, 180; 220/1.5, 220/652, 562, 668, 608; 406/119; 410/45; 414/498, 812

See application file for complete search history.

(56) References Cited

U.S. PATENT DOCUMENTS 3,726,431 A 4/1973 Botkin
4,819,830 A * 4/1989 Schultz ..... 220/371
4,823,989 A * 4/1989 Nilsson ..... 222/630
5,248,227 A * 9/1993 Hidock et al. ..... 406/41
5,529,222 A 6/1996 Toth et al.
5,911,337 A 6/1999 Bedeker
5,960,974 A 10/1999 Kee et al.
6,059,372 A 5/2000 McDonald et al.
6,085,664 A * 7/2000 Early ..... 105/377.07
6,401,983 B1 6/2002 McDonald et al.
6,418,869 B1 7/2002 Miller
7,104,425 B2 * 9/2006 Le Roy ..... 222/185.1

* cited by examiner

*Primary Examiner*—Frederick C. Nicolas
(74) *Attorney, Agent, or Firm*—Craig Barber

(57) ABSTRACT

The present invention teaches that air may be injected into the sloping bottom of a bulk dry particulate cargo container (micron-sized through quarry-sized dry particulate) accompanied by traditional conveyance-variety pneumatic air, causing the bulk dry particulate cargo to enter a bi-phase state having an air matrix with particulate inclusions. The result of this air lubrication is a dramatically reduced coefficient of friction. This bi-phase material may be extremely fluid, easily exiting a discharge port without regard to normal bulk dry particulate friction or angle of repose. The present invention also teaches a cargo container having a plurality of air injectors on the sloping bottom of a particulate plenum and having air supply apparatus feeding the air injectors.

8 Claims, 12 Drawing Sheets

INTERMODAL POWDER/BULK FREIGHT CONTAINER

CROSS-REFERENCE TO RELATED APPLICATIONS

This application is a continuation in part of previously filed U.S. application Ser. No. 10/274,185, filed Oct. 18, 2002, now U.S. Pat. No. 7,104,425, in the name of the same inventor, Curtis W. LeRoy, and entitled "Intermodal Bulk Cargo Container and Method" and claims the priority and benefit of that application, the entire specification of which is incorporated herein by this reference.

FIELD OF THE INVENTION

This invention relates generally to freight containers and specifically to an air blown system for loading and unloading of intermodal containers for powder bulk solid materials.

STATEMENT REGARDING FEDERALLY FUNDED RESEARCH

This invention was not made under contract with an agency of the US Government, nor by any agency of the US Government.

BACKGROUND OF THE INVENTION

In order to reduce the cost, time and manpower of long distance shipping, the intermodal cargo container is commonly used. Such containers are standardized shapes and sizes and usually have standardized handling devices such as standardized grips, hooks, tie downs and so on that allow shippers, handlers, stevedores, longshoreman, truckers and others to handle numerous containers quickly, almost regardless of the actual contents of the containers.

Normally, such containers are built to specifications issued by various authorities: international use of containers built to these specifications is one of the key ingredients of the modern free trade system, for without such standards, fast handling would be almost impossible. Perhaps the foremost authority for issuance of such standards is the ISO or International Standards Organization, which issues numbered standards directives. For example "ISO 1496/IV" is one standard for cargo containers, "ISO 1161" another standard for the corner locks of such containers and so on. The Association of American Railroads has similar standards on the same topic, for example AAR M-930. These standards most importantly relate to dimension, but also relate to weatherability, strength and other issues.

Shipping of bulk powders of all sizes from micron-sized through quarry-sized dry particulate can be a surprisingly aggravating proposition, even when such standardized cargo containers are utilized. Firstly, they are collectively amorphous so entirely closed containers are necessary. Powders and dry particulate matter in general tend to behave in a fashion that allows such bulk powders as food products (e.g. Grain, Flour, Sugar, Dextrose, Starch, Cake Mixes, Cocoa, Coffee, Enzymes, Nutrients, Feeds, Pet Foods, Seeds, Spices, et al.) Chemicals, (e.g. Sodium Chloride, Calcium Chloride, Calcium Carbonate, Lime, Urea, polyethylene, polypropylene, polyester, cements, adhesives, compounds, et al.) Minerals, (e.g. Clays, Fuels, Soils, Stone, et al.). However, such bulk dry particulates or powders usually have an angle of repose, even if a small one, i.e. some angle from the horizontal at which a bulk powder or particulate will rest without flowing, unlike true liquids. Thus, shipping containers for bulk powders tend to have non-flat bottoms. In commonly seen schemes, the container may be subdivided into several smaller compartments, each one with its own "chute" section on the bottom surface of the horizontal container. There are, however, disadvantages to such designs.

For example, a skin or coating of the bulk powder may adhere to the bottom or sides of the container due to frictional forces, necessitating a clean up of some type, probably manual.

Another disadvantage is that the numerous small chutes normally used decreased cargo capacity of the container. Switching to one large chute on the bottom side of the container would merely exacerbate this problem under the dictates of simple geometry.

Flow problems also arise: the typical dry particulate matter has a degree of friction which tends to impede or even block flow, while the typical container is not arranged so as to permit the easy discharge of such bulk particulate matter. These problems and other problems stem from the fact that there is no large vertical drop possible within a normal container. The typical standardized container is a matter of approximately 8 feet to 9.5 feet in height (roughly 2400 to 2900 millimeters). This cannot be increased without defeating the entire purpose for having standardized cargo containers.

Pockets or irregularities in such containers also cause retention of portions of the bulk cargo, forcing manual cleaning of the container to finish the unloading of the cargo, or even worse, posing the risk of contamination of the next cargo.

Various types of bulk cargo containers are known, and have various defects.

Those made of inherently strong materials such as heavy gauge steel plate are excessively heavy in relation to the cargo to be carried, not to mention excessively expensive to manufacture. But containers having internal frames tend to provide numerous catch basins or pockets requiring manual cleaning as described above. Containers having external frames eliminate this problem at the cost of reducing the cargo capacity of the container by the depth of the framework on all sides (because of course the framework must fit within the dimensional standards of the container and therefore the "external" frame is actually inside the edges of the container envelope, thus forcing the container itself to sit within the frame). Containers have been made of fiber reinforced plastic materials (sheets of somewhat flexible material of great strength) with external frames have been tried with limited success: potentially decreased weight but potentially decreased durability.

Various examples may be considered. U.S. Pat. No. 6,401,983 B1 issued Jun. 11, 2002 to McDonald et al for BULK CARGO CONTAINER is an example of one such. It uses a conventional horizontal container and a conventional vertical flow path: bulk materials are loaded from above through doors 138, 140 and 142 and unloaded from beneath through discharge openings such as 116.

U.S. Pat. No. 6,059,372 issued May 9, 2000 to McDonald et al for HOPPER BOTTOM TRAILER shows much the same thinking at work: a conventionally horizontal container, possibly subdivided into compartments or cells and a conventional top-in and bottom-out flow path for the bulk materials handled.

U.S. Pat. No. 5,960,974 issued Oct. 5, 1999 to Kee et al for INTERMODAL BULK CONTAINER teaches a container vessel of aluminum within a rigid outer frame with hoppers extending out the bottom of the device and domed aluminum sealing the ends. Hoppers within the shell are once again to be filled from the top and emptied from the bottom.

U.S. Pat. No. 5,529,222 issued Jun. 25, 1996 to Toth et al for DRY BULK PRESSURE DIFFERENTIAL CONTAINER WITH EXTERNAL FRAME SUPPORT teaches exactly that, once again in a substantially horizontal mode.

U.S. Pat. No. 5,911,337 to Bedecker. teaches a liner to a shipping container; an insert intended merely to replace disposable plastic liners. The device is made of approximately ⅛ inch aluminum (col. 5, lines 22 through 26) or other metal (steel, titanium) or even fiberglass or plastic (col. 6 lines 59 through 64) which may be at most reinforced with a plurality of "tension rings 726" (col. 7 line 65 through col. 8 line 4).

U.S. Pat. No. 6,418,869 to Miller, is a specialized container not having the structures of the present invention, nor is it analogous prior art.

U.S. Pat. No. 3,726,431 to Botkin shows a valve is depicted sized appropriately for liquids having no angle of repose, the opening on the top of the tank is identified not as a hatch for filling the device but as a manhole cover, and a safety rupture disk 79 is shown and described at column 4 lines 65 et seq, indicating that this device is for pressurized liquids.

All of these devices attempt to overcome the friction of the bulk cargo they carry in fairly standard ways. One common solution is to provide relatively highly angled (steep) sided hoppers at the bottom of the vessel, once again however simple geometry dictates that this solution reduces the cargo capacity of the container.

It would be greatly desirable to provide a method of gravity feed of the contents of a bulk cargo container and yet achieve good flow, without overly compromising cargo capacity, and while allowing the additional use of the various devices listed above if desired.

SUMMARY OF THE INVENTION

General Summary

The present invention teaches that air may be injected into the sloping bottom of a bulk dry particulate cargo container (micron-sized through quarry-sized dry particulate), causing the bulk dry particulate cargo to enter a bi-phase state having an air matrix with particulate inclusions. One result of this air lubrication is a dramatically reduced coefficient of friction, another may be the lifting or levitating the material off of the container floor. This bi-phase material may be extremely fluid, easily exiting a discharge port without regard to normal bulk dry particulate friction or angle of repose. The present invention also teaches a cargo container having a plurality of air injectors on the sloping bottom of a particulate plenum and having air supply apparatus feeding the air injectors.

Summary in Reference to Claims

It is therefore a first aspect, advantage, objective and embodiment of the present invention to provide a bulk dry particulate cargo container comprising:

- a plenum having a top, a bottom, and further having at least one feed hatch located at the top,
- a framework external to the plenum, the plenum supported by the framework and gaining from the framework strength;
- at least one pneumatic infeed port;
- a plurality of air injectors at the plenum bottom;
- at least one air feed pipe supplying pressurized air to the plurality of air injectors and to the pneumatic infeed port.

It is therefore a second aspect, advantage, objective and embodiment of the present invention to provide a bulk dry particulate cargo container wherein the plenum bottom is not horizontal to grade.

It is therefore another aspect, advantage, objective and embodiment of the present invention to provide a bulk dry particulate cargo container further comprising:

- at least one air/particulate discharge port.

It is therefore another aspect, advantage, objective and embodiment of the present invention to provide a bulk dry particulate cargo container wherein the at least one air/particulate discharge port is located at the bottom of the plenum.

It is therefore another aspect, advantage, objective and embodiment of the present invention to provide a bulk dry particulate cargo container further comprising:

- an air only exhaust port.

It is therefore another aspect, advantage, objective and embodiment of the present invention to provide a bulk dry particulate cargo container wherein each of the plurality of air injectors further comprises: an air deflector.

It is therefore another aspect, advantage, objective and embodiment of the present invention to provide a bulk dry particulate cargo container wherein the air deflector further comprises one member selected from the group consisting of: a hat, a u-bend, and combinations thereof.

It is therefore another aspect, advantage, objective and embodiment of the present invention to provide a bulk dry particulate cargo container wherein the plurality of air injectors penetrate the plenum bottom.

It is therefore another aspect, advantage, objective and embodiment of the present invention to provide a bulk dry particulate cargo container wherein the pneumatic infeed port is located at the top of the plenum.

It is therefore another aspect, advantage, objective and embodiment of the present invention to provide a bulk dry particulate cargo container further comprising:

- a plenum side, wherein the plurality of air injectors extend downwards parallel to the plenum side from a location near the plenum top to a location near the junction of the plenum bottom and the plenum side.

It is therefore another aspect, advantage, objective and embodiment of the present invention to provide a bulk dry particulate cargo container It is therefore yet another aspect, advantage, objective and embodiment of the present invention to provide a method of unloading bulk dry particulate cargo from a container having a top and a bottom and a side, the method comprising:

- providing a first exit port at such bottom of such container;
- injecting air under pressure into such container;
- thereby creating a free flowing bi-phase mixture of bulk dry particulate cargo and air.

It is therefore yet another aspect, advantage, objective and embodiment of the present invention to provide a method of unloading bulk dry particulate cargo from a container having a top and a bottom and a side, further comprising:

- injecting the air under pressure from a location near such container top to a location near the junction of such container bottom and such container side.

It is therefore yet another aspect, advantage, objective and embodiment of the present invention to provide a method of unloading bulk dry particulate cargo from a container having a top and a bottom and a side, further comprising:

injecting the air under pressure to an area covering a portion of the plenum bottom.

It is therefore yet another aspect, advantage, objective and embodiment of the present invention to provide a method of unloading bulk dry particulate cargo from a container having a top and a bottom and a side, further comprising:

providing air injectors through which the air under pressure is injected.

INDEX OF THE REFERENCE NUMERALS

| | |
|---|---|
| Dry bulk particulate container | 100 |
| Frame | 102 |
| Corner Fitting | 102.5 |
| Corner brace | 103 |
| First plenum | 104 |
| Hatch/infeed port | 106 |
| Air only exhaust port | 108 |
| Air/particulate exhaust port | 110 |
| Plenum top | 112 |
| Plenum bottom | 114 |
| Plenum side | 116 |
| First plenum | 204 |
| Hatch | 206 |
| Particulate feed | 218 |
| First plenum | 304 |
| Hatch/feed port | 306 |
| Pneumatic feed port | 320 |
| Pneumatic particulate feed | 322 |
| Pneumatic particulate feed main | 324 |
| Particulate | 326 |
| Air only exhaust port | 408 |
| Air exhaust | 428 |
| Air/particulate exhaust port | 510 |
| Pneumatic inlet port | 520 |

-continued

| | |
|---|---|
| Air/particulate | 530 |
| Hatch | 606 |
| First plenum | 632 |
| Second plenum | 634 |
| First plenum | 704 |
| Plenum support surface | 738 |
| Grade | 840 |
| Plenum bottom plane | 842 |
| Plenum bottom | 914 |
| Air injector | 950 |
| Air injector deflector | 952 |
| Direct airflow | 954 |
| Indirect airflow/air/particulate | 956 |
| Injector air feed line | 958 |
| Plenum bottom | 1014 |
| Air injector | 1050 |
| Air injector deflector | 1052 |
| Direct airflow | 1054 |
| Air/particulate flow | 1056 |
| Injector air feed | 1058 |
| Air/particulate discharge port | 1110 |
| Plenum bottom | 1114 |
| Air injector | 1150 |
| Air infeed flotation supply | 1160 |
| Air particulate discharge | 1162 |
| Air/particulate flow | 1164 |
| Air feed main | 1166 |
| Air injector feed | 1168 |
| Cross feed | 1170 |
| Plenum top | 1212 |
| Plenum bottom | 1214 |
| Air infeed supply | 1260 |
| Air feed main | 1272 |
| Air drop | 1274 |
| Discharge end of air drop | 1276 |

DETAILED DESCRIPTION

Figure 1:
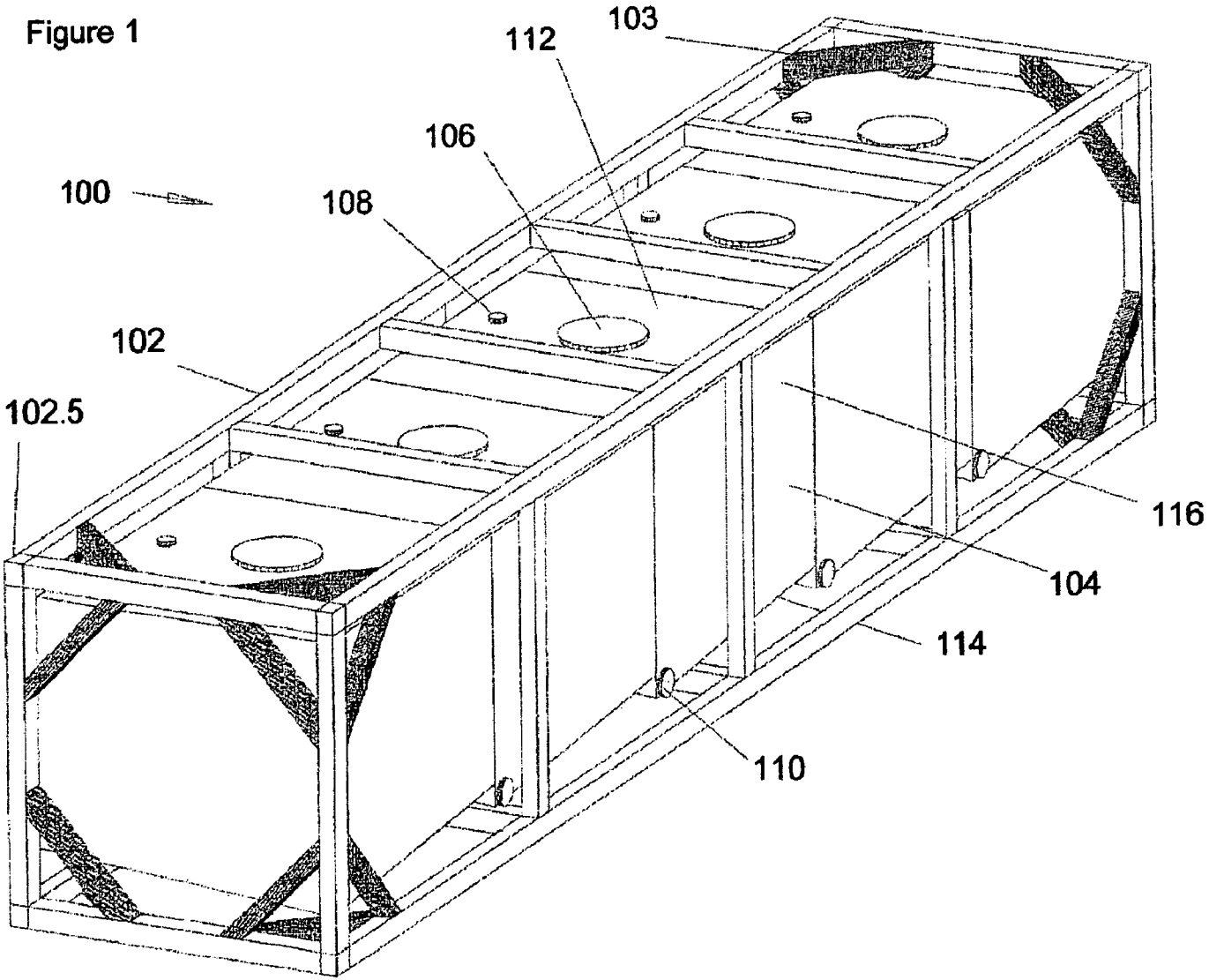
FIG. 1 is an orthogonal front elevational overview of a first embodiment of the invention.

FIG. 1 is an orthogonal front elevational overview of a first embodiment of the invention. Dry bulk particulate container 100 comprises frame 102 surrounding at least one plenum. Corner fittings 102.5 are particularly important for dimensional control and handling. Corner brace 103 adds strength to the overall framework. The materials of the device may be mild steel, aluminum, stainless steel or other metals or other equally-strong materials such as composites. The corner brace 103 not only supplies strength but also rigidity. The details of frames and bracing may be modified to suit the size and/or application for which it is made.

The overall dimensions of the device conform to various published standards.

First plenum 104 from among the plurality of plenums used in preferred embodiments has a plenum top 112, a plenum bottom 114 and plenum side 116. Plenum bottom 114 is very gently sloped. In contrast to prior art having quite steeply sloped bottoms which form chutes designed to exceed the angle of repose of the intended cargo, this invention allows more efficient use of the container space, as the slope may be quite gentle. In preferred embodiments, the slope may be close to zero, for example, slopes of under 25 degrees may be used, preferably slopes of under 15 degrees. Slopes of zero degrees may in fact be used (in some instances), due to the dramatic reduction in coefficient of friction of the cargo when it is entrained into an air/particulate matrix. The plenum materials may be mild steel, stainless steel, fiberglass, polymers such as Polyethylene, Polypropylene, Polyester, Specialty Resins and composites. In embodiments, there may also be various paints both interior and/or exterior . . . the nature being determined by the application for which the container was intended.

The device may in embodiments be refrigerated, with suitable space limitations imposed by the necessity of providing refrigeration equipment within the standard dimensions.

Hatch 106 is in the best modes contemplated located at the plenum top 112. This hatch may be large enough for human use, for example for cleaning, repairs and maintenance, however, the hatch is intended for gravity feed of bulk dry particulate cargo as discussed in relation to later figures.

Air only exhaust port 108 may also be located at the plenum top 112. This exhaust port is designed to allow air to exhaust there from, particularly during pneumatic feeding of bulk dry particulate cargo into the container's plenum 104. It may be arranged so as to prevent exit of particulate cargo with the air. This may be achieved by means of an air velocity drop chamber which reduces air velocity, causing any suspended matter to drop out, or by means of a serpentine passage, a filter, or merely due to positioning at the top of the plenum.

Air/particulate exhaust port 110 is a key feature of the present invention. This air/particulate exhaust port 110 allows easy exit of an air/particulate cargo mix from the plenum of the container, when the particulate cargo itself, and/or the plenum bottom/floor has been air lubricated so that it has a dramatically reduced coefficient of friction. The particulate is semi-suspended or completely suspended in the air, forming a two phase mixture of an air matrix with particulate inclusions, in the method and structure of the invention.

A mixture of air and particulate has certain very positive qualities. Firstly, the angle of repose is reduced to approximately zero, meaning that the mixture will flow more like a liquid and resist agglomeration and bridging tendencies. Unless considerable support is present, the mixture will be less likely to form piles. The mixture may also easily traverse gentle curves and even pass at speed through relatively small ports, hatches, apertures, pipes, conduits, chutes and tubes. In addition, by adjusting the air flow the particulate cargo may be made to move more rapidly, thus reducing the speed of cargo handling, or in the alternative, allowing handling to occur by means of upstream and/or downstream handling equipment having smaller bores.

The terms "at the plenum top" and "at the plenum bottom" as used herein do not restrictively mean that the port or hatch in question may only penetrate the structural top or bottom itself. Areas of the plenum sides coterminuous to the top or bottom may be included in the term as well. Thus it will be seen that the exhaust port 110 may is in fact be located at the plenum bottom, despite penetrating the plenum side or as an alternative to side-penetration entirely.

Figure 2:
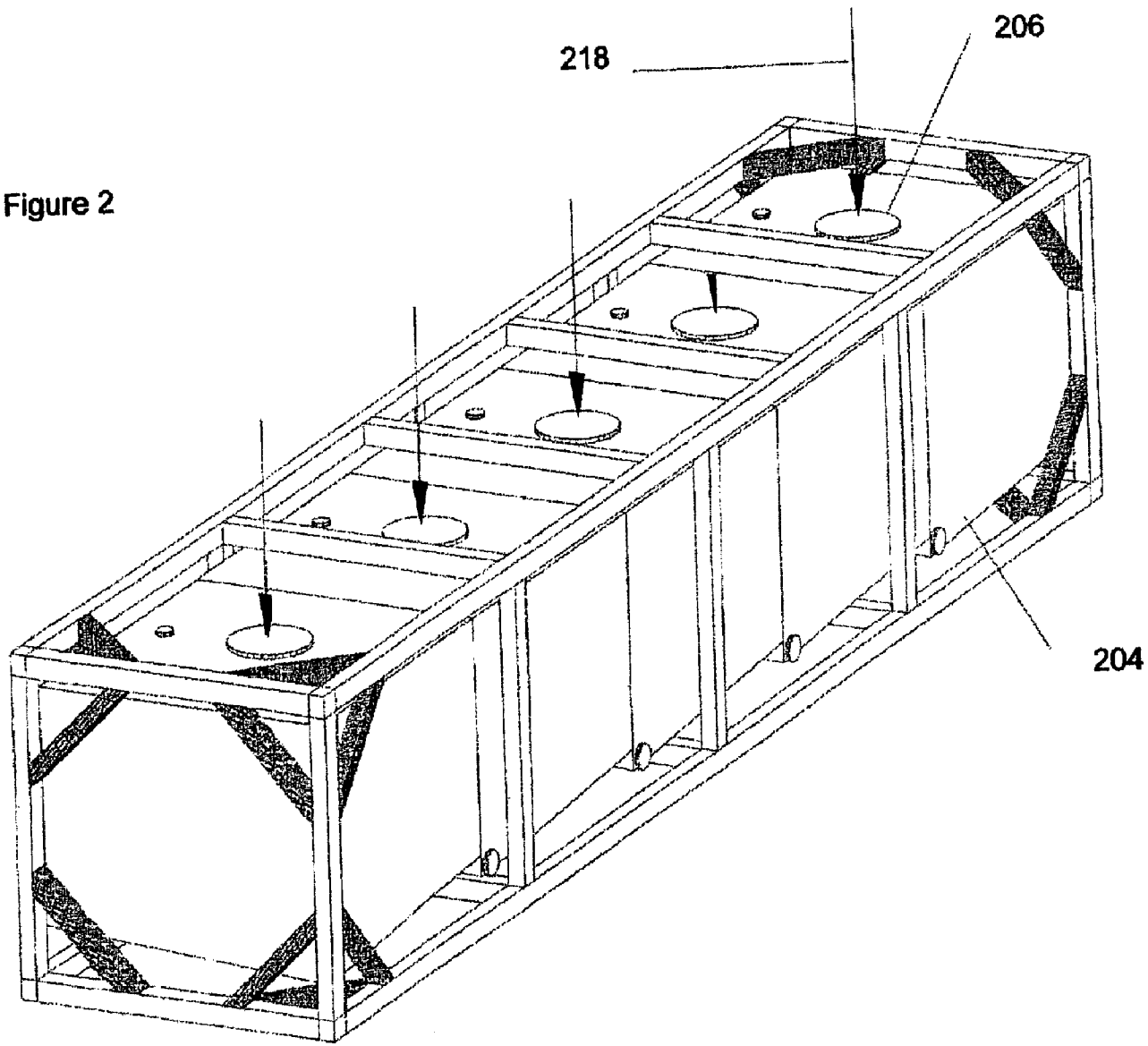
FIG. 2 is an orthogonal front elevational overview of a second embodiment of the invention during gravity loading/feed of bulk dry particulate cargo.

FIG. 2 is an orthogonal front elevational overview of a second embodiment of the invention during gravity feed of bulk dry particulate cargo. The cargo flows downwards into first plenum 204 via hatch 206. Particulate feed 218, shown schematically, may be a conduit, a chute, hopper, tube, pipe, etc. This may (in embodiments) be a completely conventional method (e.g. gravity feed) of loading of the cargo, thus demonstrating that the device may be loaded at conventional loading facilities (grain elevators, factories, gravel quarries, etc) which may not otherwise be equipped for aspects of the invention. As the number of locations which will wish to load the device is large, it is convenient commercially to allow the device an easy loading technique.

Figure 3:
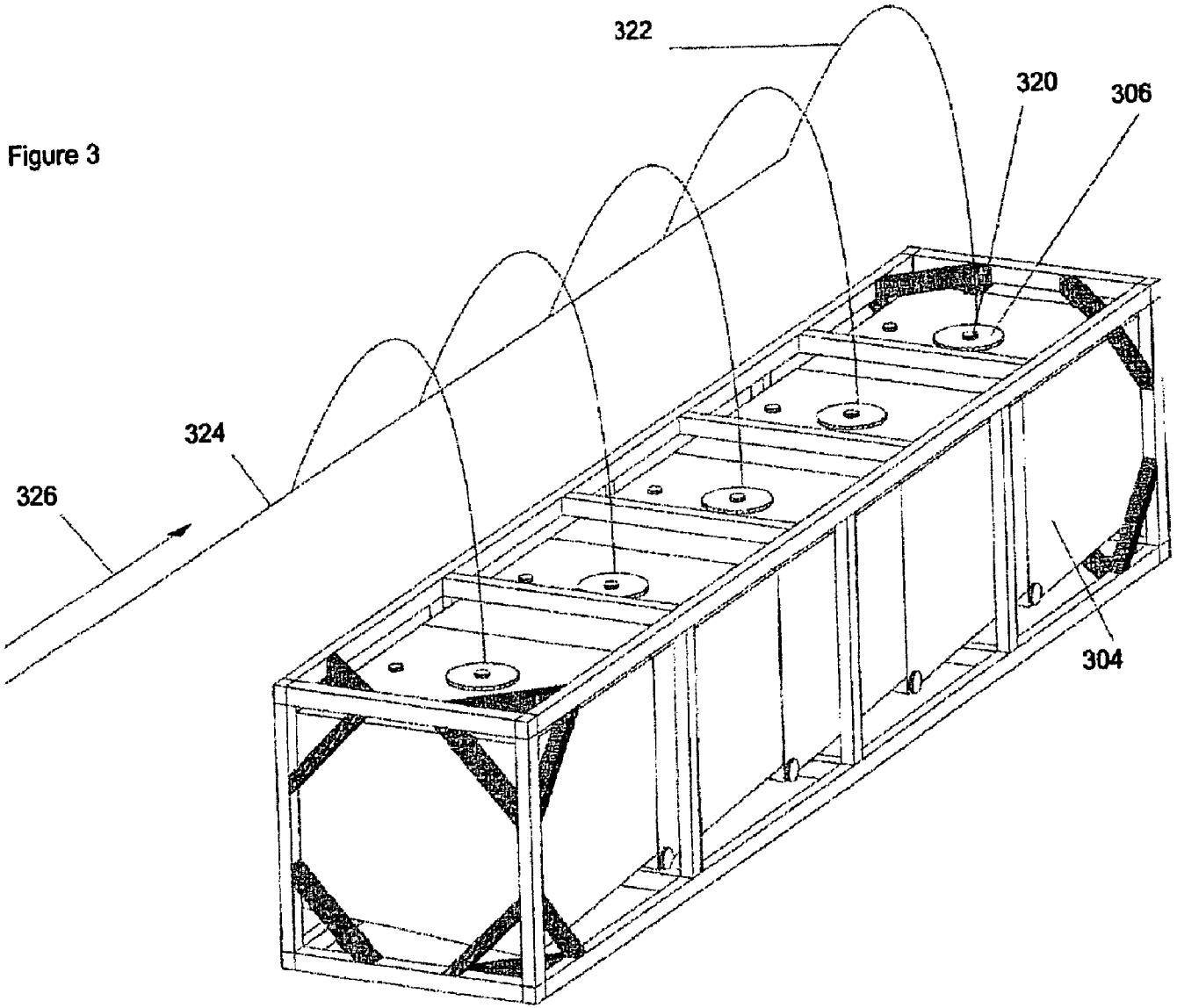
FIG. 3 is a schematic diagram of pneumatic loading/feed of bulk dry particulate cargo into a ninth embodiment of the invention.

FIG. 3 is a schematic diagram of pneumatic feed (as an alternative to gravity loading) of bulk dry particulate cargo into a ninth embodiment of the invention. First plenum 304 is fed particulate 326 (or more properly, particulate stream 326) via a part of hatch 306: a pneumatic feed port 320. This feed port, like air/exhaust port 110 of a previously discussed embodiment, allows the bi-phase mixture of air/particulate, with its extremely low coefficient of friction, to pass.

While in the embodiment pictured the feed port is depicted to be located at hatch 306, in other embodiments of the invention claimed, it may be located else where in the a plenum top, plenum side and conceivably even a plenum bottom, since the air/particulate mixture has nearly fluid qualities as discussed in reference to FIG. 1. Pneumatic particulate feed 322, depicted schematically, may be a conduit, a chute, hopper, tube, pipe, etc. Pneumatic particulate feed main 324 may also be a conduit, a chute, hopper, tube, pipe, however, in preferred embodiments and best modes now contemplated, the inner diameter of main 324 may be enlarged in comparison to feed 322, thus allowing main 324 to adequately provide volume to several feeds. In or upstream of main 324, the particulate may be entrained into the moving air matrix using blowers, fans, plenums, jets and so on.

Importantly, the pneumatic feed 322 may feed air into the plenum at the time of discharge of the cargo. However, this is not the only location providing pressurized air for discharge, as will be discussed below in reference to FIGS. 9 through 12.

Figure 4:
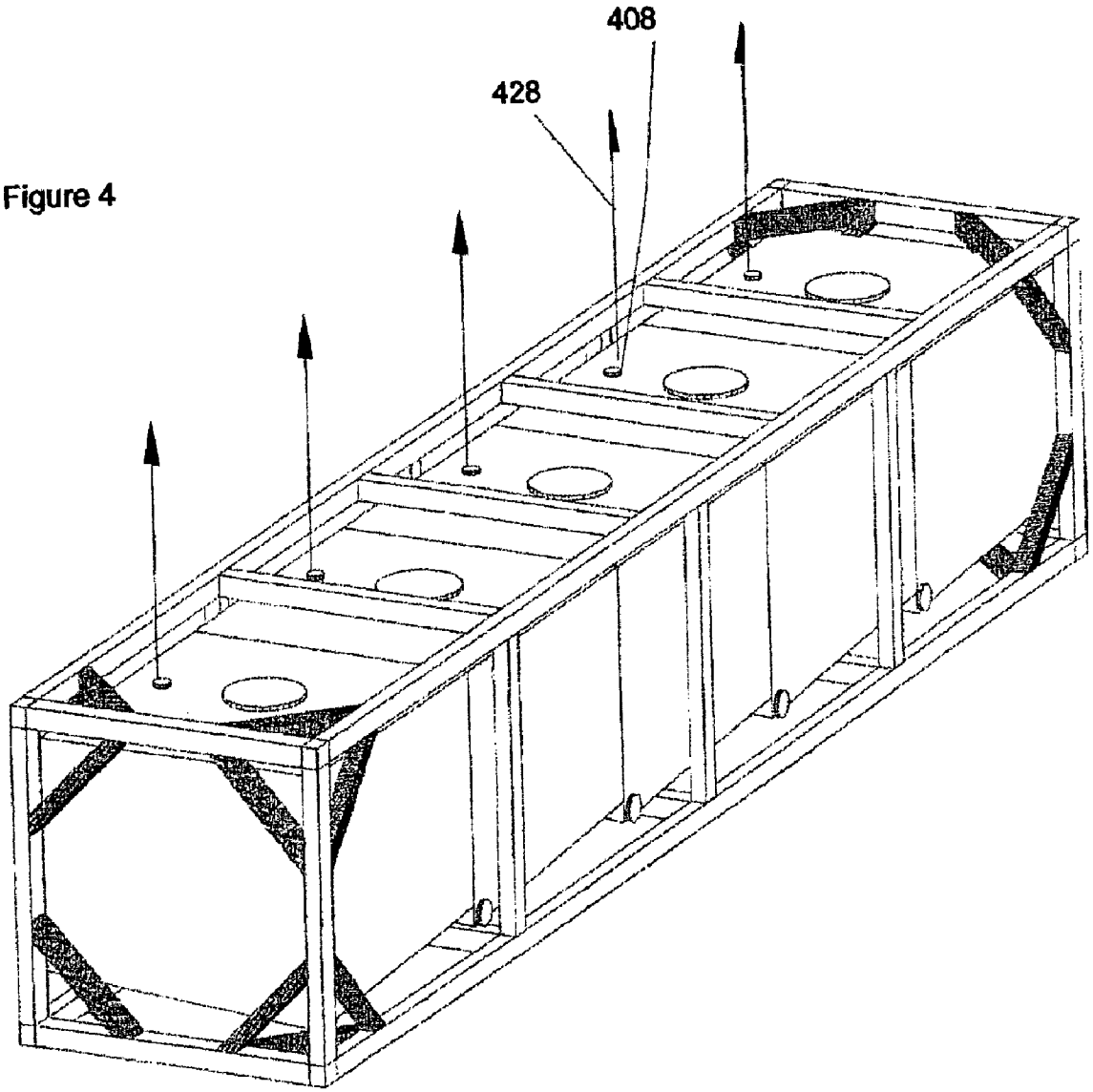
FIG. 4 is a schematic diagram of air exhaust during feed of bulk dry particulate cargo into a tenth embodiment of the invention.

FIG. 4 is a schematic diagram of air exhaust during feed of bulk dry particulate cargo into a tenth embodiment of the invention. Air only exhaust port 408 allows air exhaust 428 to exit the plenum without entrained particulate matter embedded therein. This is particularly important during pneumatic feed of particulate into the plenum, when the air/particulate matter does enter the plenum in a single bi-phase mixture. Merely being position at the top of the plenum has proven to be sufficient for some mixtures of air speed, pressure, and particulate density, etc. It may more aggressively have equipment so as to prevent exit of particulate cargo with the air. This may be achieved, as note previously in regard to FIG. 1, by means of a air velocity drop chamber which reduces air velocity, causing any suspended matter to drop out, or by means of a serpentine passage, a filter, or merely due to positioning at the top of the plenum.

Figure 5:
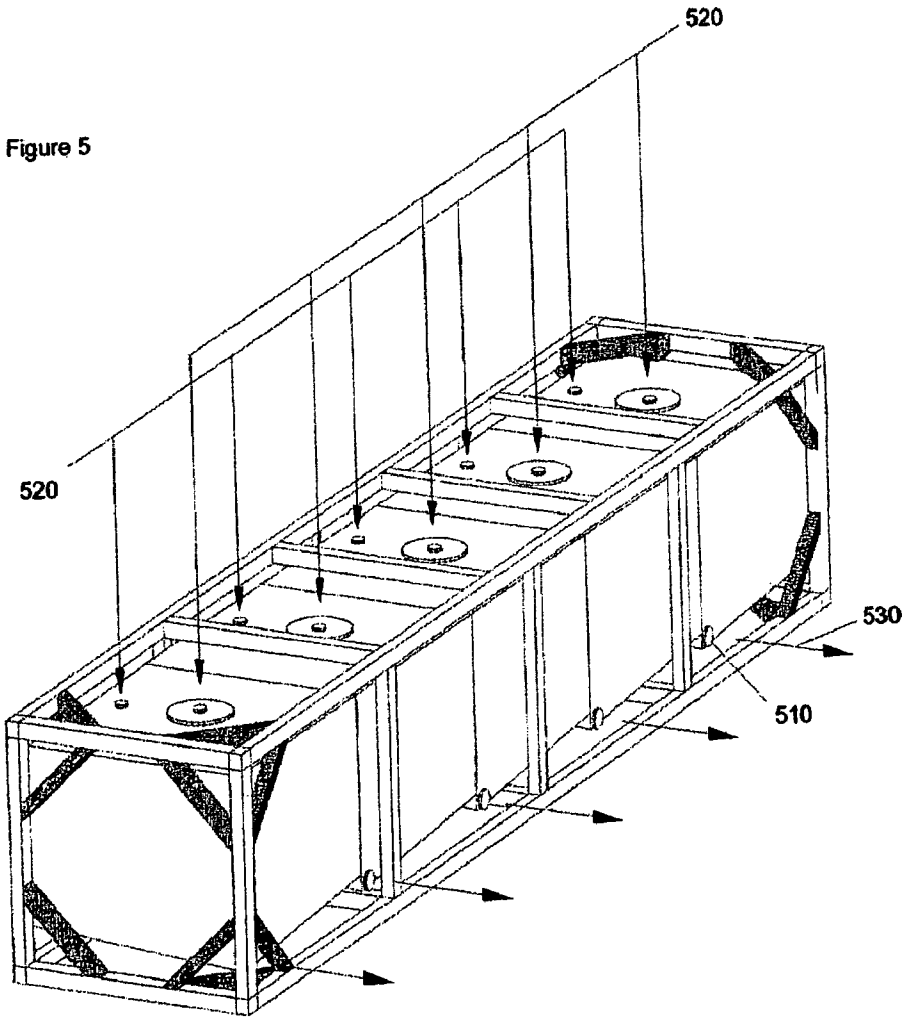
FIG. 5 is a schematic diagram of bulk dry particulate cargo discharge out of an eleventh embodiment of the invention.

FIG. 5 is a schematic diagram of bulk dry particulate cargo discharge out of an eleventh embodiment of the invention. Air/particulate exhaust port 510 carries the air/particulate 530 as it exits the plenum. The diameter of port 510 and pressure of the flow contribute directly to the volume per time unit of cargo actually discharged by these means. Air/particulate 530 may be discharged as shown, or it may exit into a receiving conduit or chamber of some type for further handling. Disentrainment of the particulate cargo from the air will occur automatically under the laws of fluid dynamics whenever the air/particulate stream 530 is slowed, as slower fluids promptly drop whatever particulate burden they bear. Such a slowing may occur simply allowing the receiving space to be an even larger plenum (such as a silo, hopper warehouse floor or the like) in which the air expands and slows, or slowing may be caused by means of baffles, filters, cyclones, etc. Filters may also be directly used to trap the particulates without slowing, as may centrifugal action and the like.

Pneumatic ports 520 may be used to provide air only for discharge or air/particulate mixtures, as discussed in reference to FIGS. 3 and 4.

One extremely interesting aspect of the present invention is that "downstream" equipment at any stage may in fact be located at a higher elevation than the source of the air/ particulate mixture. For example, using the device of the invention, the source of the infeed may be considerably lower than the cargo container, and at discharge, the receiving location may be located at a higher elevation than the cargo container. Normally this would require expensive lifting equipment in addition to the normal lading equipment. However by means of the present invention, the same equipment used to load/unload may also easily lift the particulate. This reduction of secondary and tertiary equipment is one aspect of the present invention which provides a considerable commercial advantage.

Figure 6:
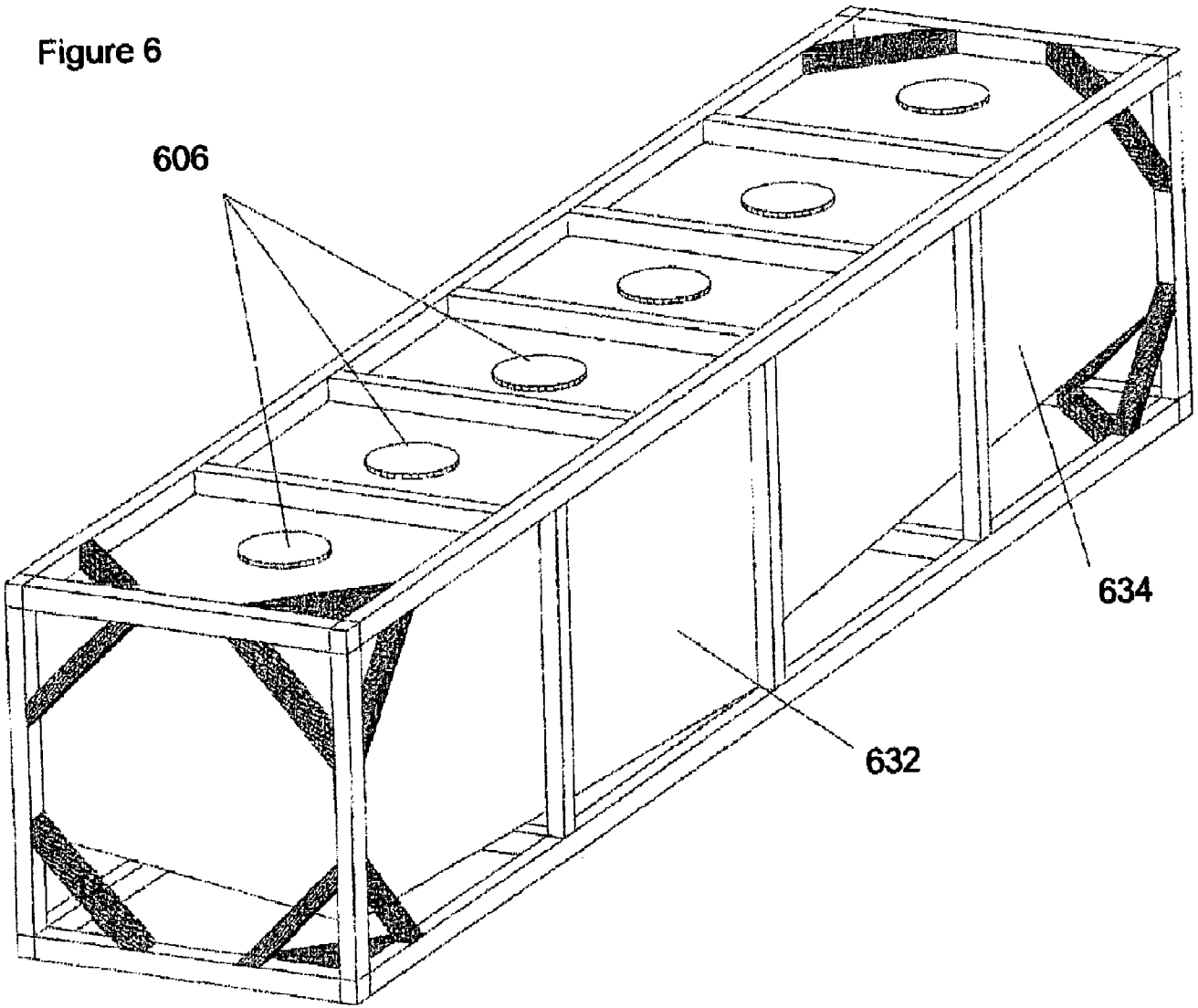
FIG. 6 is an orthogonal front elevational overview of a third embodiment of the invention.

FIG. 6 is an orthogonal front elevational overview of a third embodiment of the invention. The embodiment demonstrates that various different numbers and sizes of plenums may be used. First plenum 632 and second plenum 634 are be the only plenums in the device. One, two, three, four, five, and more plenums may be used, up to a fairly substantial number.

Note that first plenum 632 may have more than one hatch: hatch 606 is triplicated in this embodiment, but numbers of hatches from one to five or more, up to a fairly substantial number, may be used.

Figure 7:
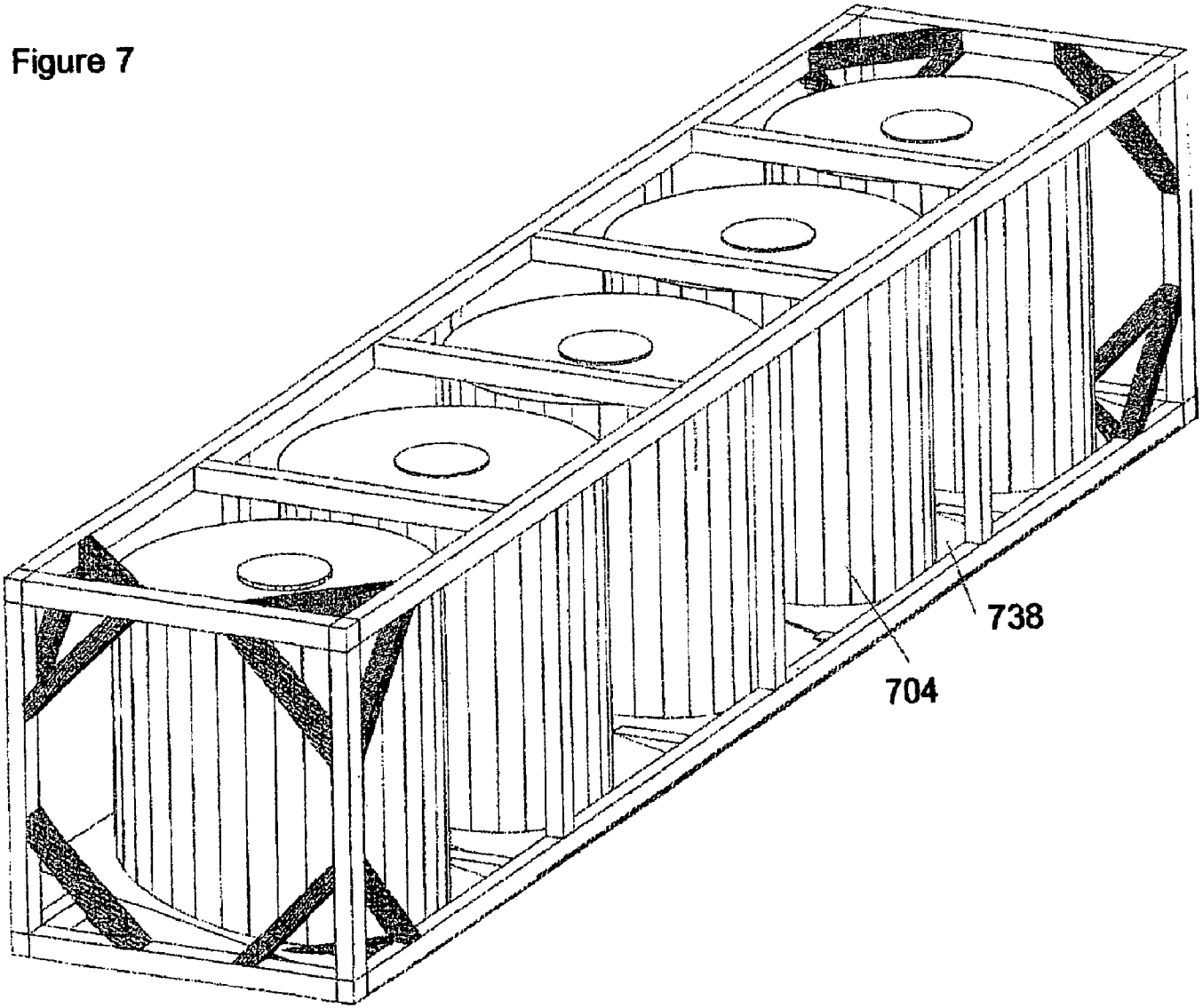
FIG. 7 is an orthogonal front elevational overview of a fourth embodiment of the invention.

FIG. 7 is an orthogonal front elevational overview of a fourth embodiment of the invention, demonstrating that the device may have plenums of different shapes. First plenum 704 is in this embodiment approximately cylindrical. Plenum support surface 738 shows that differing constructions may be used in the device. In this case, the plenum support surface 738 may be the plenum bottom or it may be a support underneath the plenum bottom. In addition, this support surface is slanted from side to side to provide the gentle slope to the plenum bottom discussed earlier. In this embodiment the discharge (not shown) is from the lowest point on the bottom of the plenum.

Note that in embodiments, the plenum bottoms of any embodiment having two or more plenums may be reverse sloped, that is, one may slope one direction while another slopes another direction. This may be used to assist in maintaining alter the center of gravity of the container when full.

Figure 8:
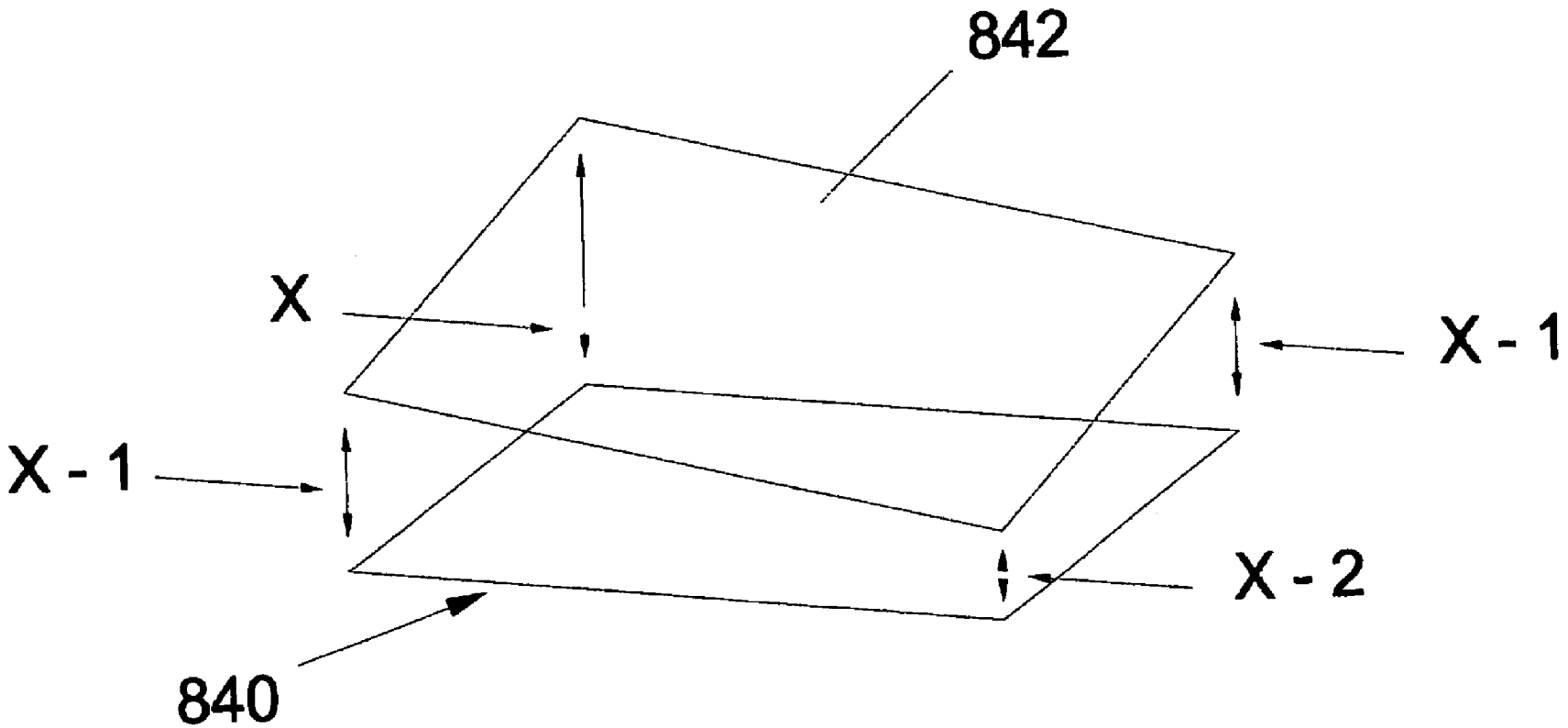
FIG. 8 is a schematic diagram of a sloping plenum bottom according to the invention.

FIG. 8 is a schematic diagram of a sloping plenum bottom according to the invention. Grade 840 represents local horizontal under normal conditions, or, when the grade is not horizontal, it at least represents the grade of, for example, the local rail bed. Plenum bottom plane 842 on the other hand, represents the slant of the plenum bottom. In embodiments this slant may run side to side, front to back, or as depicted in FIG. 8, the plenum bottom may run downwards in a diagonal direction, resulting in one corner, X-2, which is lower than any other corner. The slant may also be irregular or cover only a portion of the plenum bottom. In the preferred embodiments and best modes now contemplated, the discharge may be at the lowest point of the sloping plenum bottom.

Figure 9:
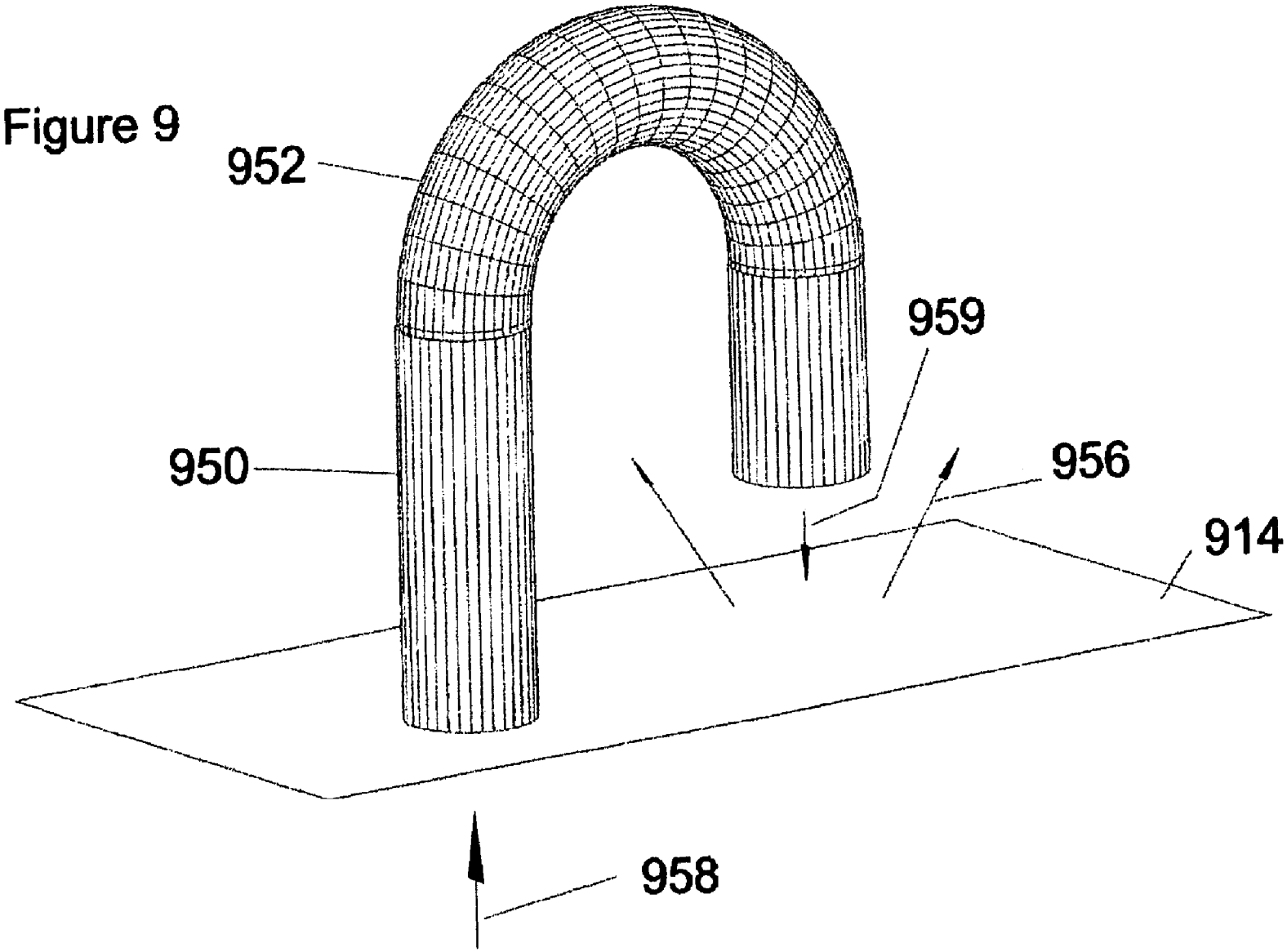
FIG. 9 is a partial orthogonal rear view of a fifth embodiment of the invention.

FIG. 9 is a partial orthogonal rear view of a fifth embodiment of the invention. Plenum bottom 914 is penetrated by air injector 950, which allows air injection to the plenum at the bottom. Air injector deflector 952 causes the direct airflow 954 to be directed in a substantially downwards or substantially horizontal direction. Indirect airflow or air/particulate stream 956 represents the air flow after entraining particulate cargo within it. The air/particulate matrix now flows as a stream, allowing extremely fluid-like flow. Also, the curvature of the fittings is such to preclude the contents from entering the line of the injector, substantially reducing or eliminating the possibility of clogging and the like. Cleaning may also take place by flushing the lines with air or an appropriate solution.

Injector air feed line 958 depicted schematically provides air flow into the injector, and may be a pipe, conduit, tube, hose, etc.

Figure 10:
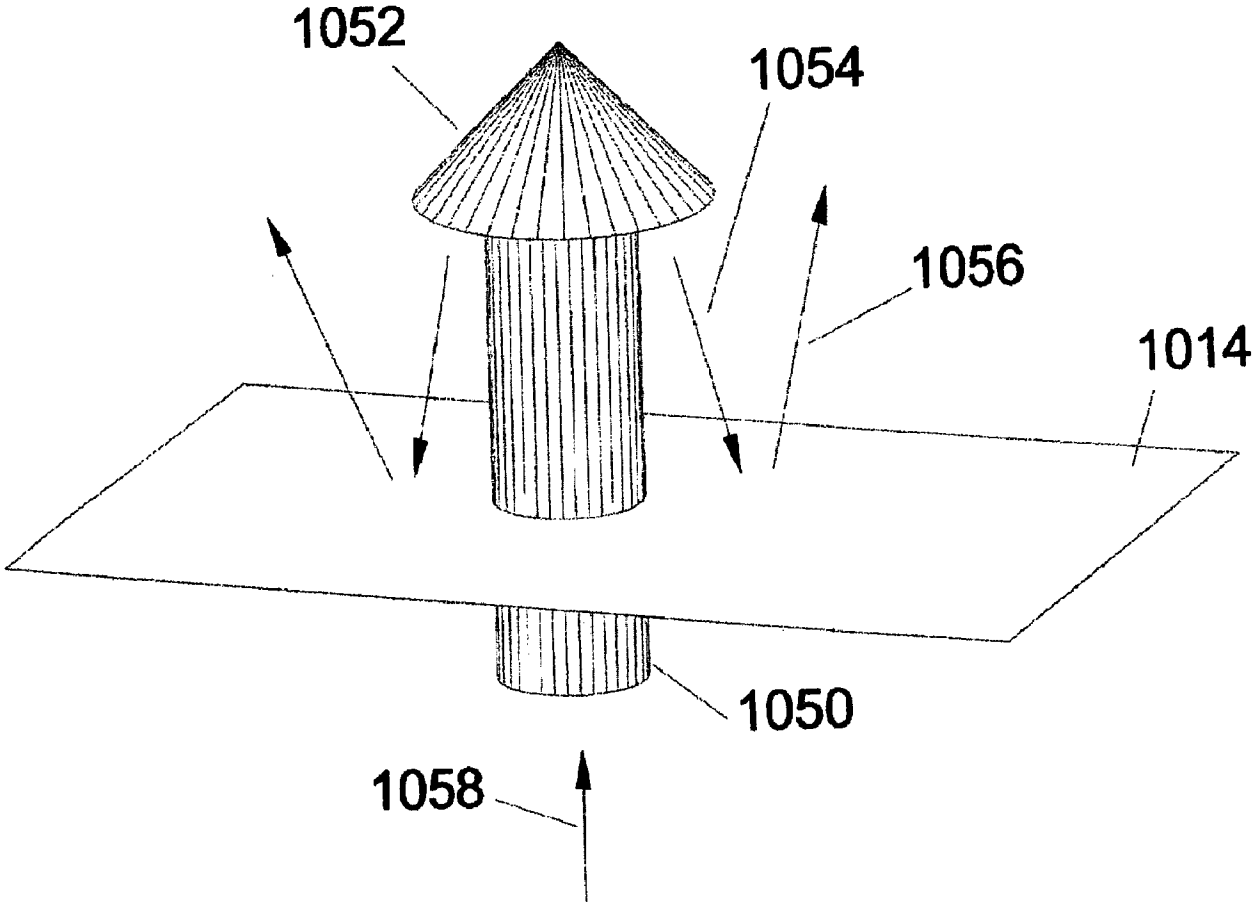
FIG. 10 is a partial orthogonal side view of a sixth embodiment of the invention.

FIG. 10 is a partial orthogonal side view of a sixth embodiment of the invention. Plenum bottom 1014 also has air injector 1050 having air injector deflector 1052 which causes pressurized direct airflow 1054 to remain close to the plenum bottom 1014. Air/particulate flow 1056 is as discussed in reference to previous embodiments. Injector air feed line, hose, etc, 1058 is as discussed previously. Also, the curvature of the fittings is such to preclude the contents from entering the line of the injector, substantially reducing or eliminating the possibility of clogging and the like. Cleaning may also take place by flushing the lines with air or an appropriate solution.

Note that the air injector and deflector may take many forms. In the embodiments shown, a U-bend or hat are used, however, the invention is not so limited: tubes with multiple air holes or other deflectors may be used.

Figure 11:
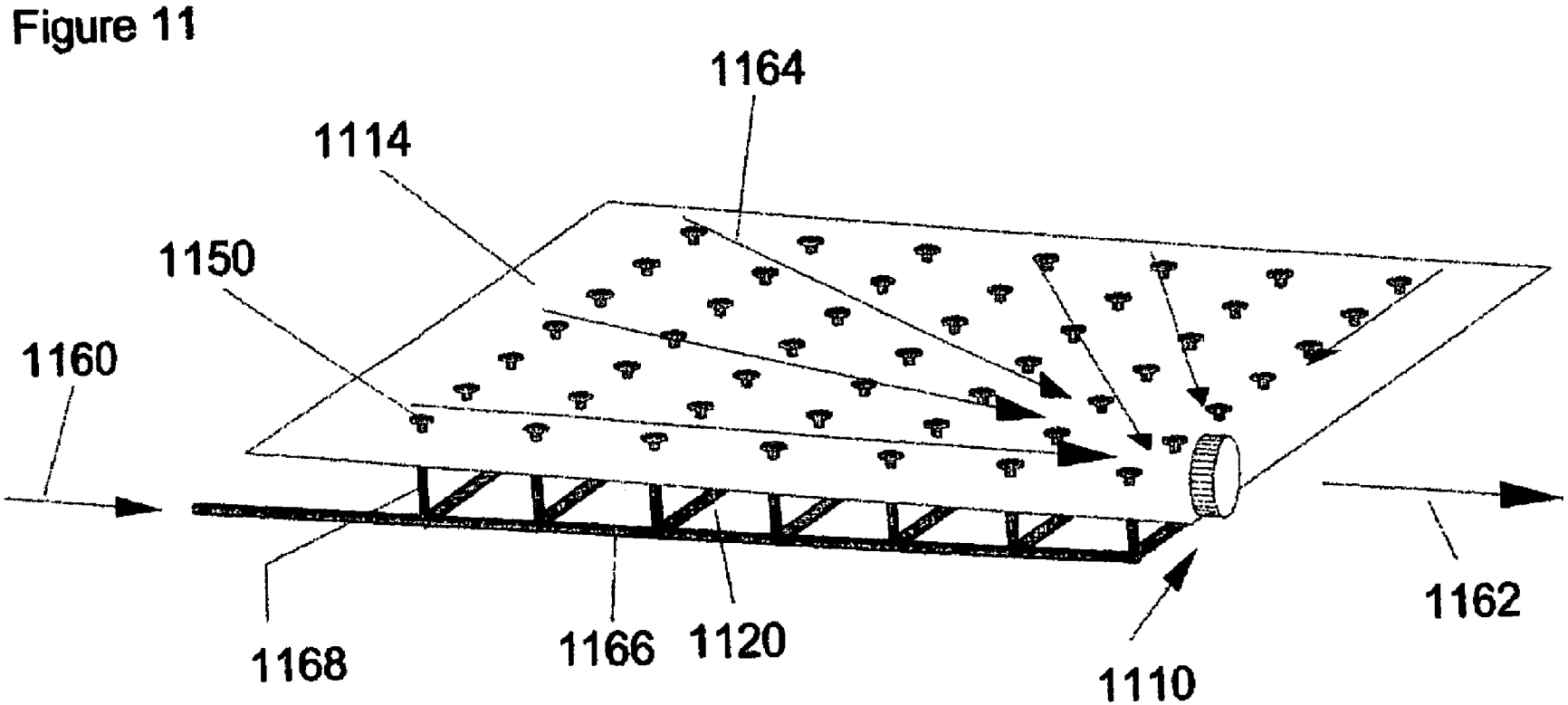
FIG. 11 is an elevational side view of a container bottom, air supply, discharge port and schematic bulk dry particulate motions of a seventh embodiment of the invention.

FIG. 11 is an elevational side view of a container bottom, air supply, discharge port and schematic bulk dry particulate motions of a seventh embodiment of the invention. Air/particulate discharge port 1110 is fed by air/particulate flow 1164 across plenum bottom 1114 to produce air particulate discharge 1162.

Air injector 1150 is fed from air infeed flotation supply 1160 via air feed main 1166 to air injector feed 1168. Cross feed 1170 may help to ensure pressurized air supply to air injectors located further from the air feed main 1166.

Note that the air injection shown in this diagram acts, in the presently preferred embodiment and best mode now contemplated, as an almost "secondary" source of "lubrication" air pressure. At the plenum top or other location, a "primary" source of "transport" air is used to provide a greater air mass through ports such as shown in earlier diagrams: 320, 520, 408, etc. The plenum bottom air injection is intended to keep to cargo from becoming static on the shallowly-sloped plenum bottom, thereby ensuring dynamic flow towards the discharge port. A third source of air ("sidewall" air) is also available, as shown in FIG. 12.

Figure 12:
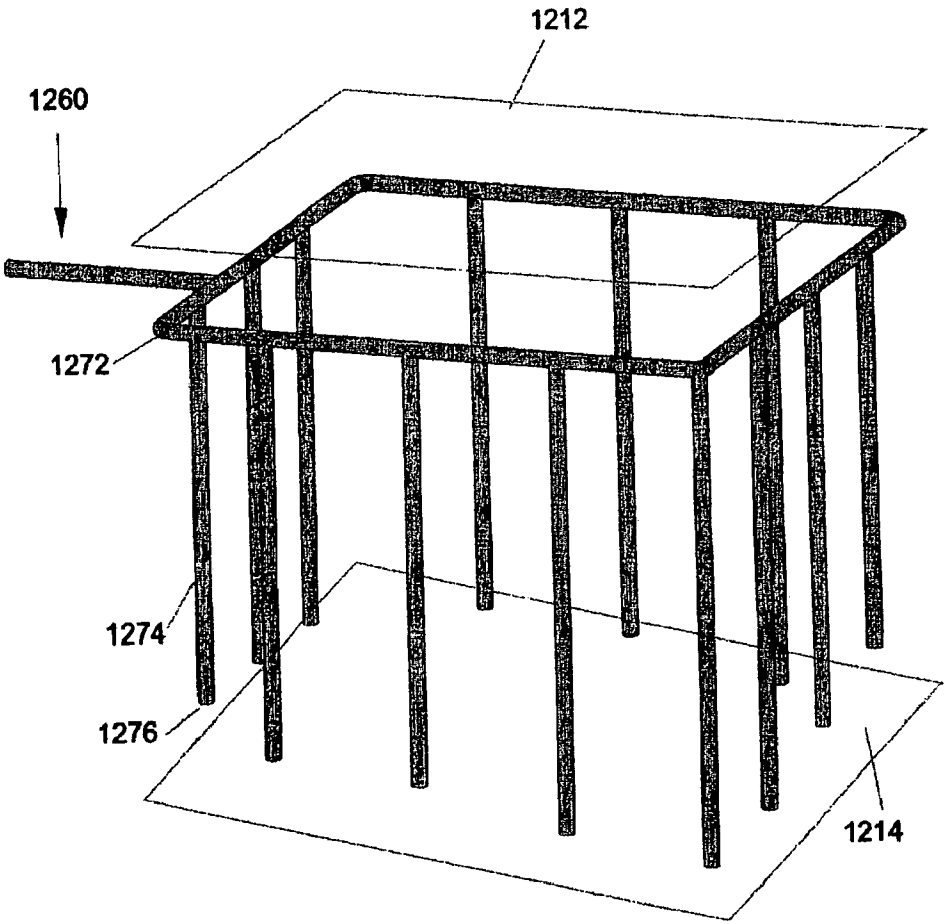
FIG. 12 is an orthogonal side view of a sidewall release apparatus, plenum top, and plenum bottom of an eighth embodiment of the invention.

FIG. 12 is an orthogonal side view of a sidewall release apparatus, plenum top, and plenum bottom of an eighth embodiment of the invention. Plenum top 1212 and plenum bottom 1214 are depicted schematically. Note that in practice, particulate cargo is most likely to "pile up" at the junction of plenum bottoms and sides, where it may receive support below and on a side. This invention may more particularly entrain or substantially disrupt such piled particulate.

Air infeed supply 1260 feeds air feed main 1272, which in turn feeds pressurized air to perforated air drop 1274. The air drop 1274 has perforated sides to discharge air against the sidewalls and disrupt any bridged material that may be hanging against the sidewalls of the plenum. These perforations may be present all along the length of air drop 1274, or in selected portions, may be of uniform or differing sizes and shapes, etc. Discharge end of air drop 1276 is thus positioned close to the junction of plenum bottom and side, where it may consistently entrain or disrupt particulate piled up at that location, forcing it to flow as part of a bi-phase matrix with a newly synthesized and substantially reduced angle of repose.

Note that the air injection shown in this diagram acts, in the presently preferred embodiment and best mode now contemplated, as an almost "secondary" source of air pressure. At the plenum top or other location, a "primary" source of air is used to provide a greater air mass through ports such as shown in earlier diagrams: 320, 520, 408, etc.

Method embodiments of the present invention may comprise some or all of the following steps for unloading of bulk dry particulate cargo from a container having a top and a bottom and a side:

I) providing a first exit port at such bottom of such container;

II) providing air injectors through which the air under pressure is injected.

III) injecting air under pressure into such container; thereby creating a free flowing bi-phase mixture of bulk dry particulate cargo and air either:

IIIA) wherein the injection occurs from a location near such container top to a location near the junction of such container bottom and such container side.

or:

IIIB) wherein the injecting the air under pressure is to an area covering a portion of the plenum bottom.

Air injection may occur in one or more locations and methods. Firstly, a portion of air injection occurs through a port such as 320 or 408 which is located near the top of the container and is capable of allowing a large air mass entry. Without wishing to be bound by any particular theory, the air introduced through feed 1160 may be considered to lift, break up, levitate or greatly lubricate the material near the bottom of the plenum in addition to serving as transport air. Finally, the air through the sidewall drop tubes may break free cargo from the sides of the plenum if it is piled at that location, and may transport cargo as well.

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

What is claimed is:

1. A bulk dry particulate cargo container comprising:

a plenum having a top, and a bottom, and further having at least one feed hatch located at the top, a framework external to the plenum, the plenum supported by the framework and gaining from the framework strength;

at least one pneumatic infeed port;

a plurality of air injectors at the plenum bottom, each of the plurality of air injectors having an air deflector comprising one member selected from the group consisting of: a hat, a u-bend, and combinations thereof;

at least one air feed pipe supplying pressurized air to the plurality of air injectors and to the pneumatic infeed port.

2. The bulk dry particulate cargo container of claim 1, wherein the plenum bottom is not horizontal to grade.

3. The bulk dry particulate cargo container of claim 1, further comprising:

at least one air/particulate discharge port.

4. The bulk dry particulate cargo container of claim 3, wherein the at least one air/particulate discharge port is located at the bottom of the plenum.

5. The bulk dry particulate cargo container of claim 1, further comprising:

at least one air only exhaust port.

6. The bulk dry particulate cargo container of claim 1, wherein the plurality of air injectors penetrate the plenum bottom.

7. The bulk dry particulate cargo container of claim 1, further comprising:

a plenum side, wherein the plurality of air injectors extend downwards parellel to the plenum side from a location near the plenum top to a location near the junction of the plenum bottom and the plenun side.

8. The bulk dry particulate cargo container of claim 1, wherein the pneumatic infeed port is located at the top of the plenum.

* * * * *